US006361014B1

(12) United States Patent
Lopez

(10) Patent No.: US 6,361,014 B1
(45) Date of Patent: Mar. 26, 2002

(54) CONCRETE FORM WALER BRACKET

(75) Inventor: Manuel Lopez, Arlington Heights, IL (US)

(73) Assignee: Symons Corporation, Des Plaines, IL (US)

( * ) Notice: Subject to any disclaimer, the term of this patent is extended or adjusted under 35 U.S.C. 154(b) by 0 days.

(21) Appl. No.: 09/350,770

(22) Filed: Jul. 9, 1999

(51) Int. Cl.[7] ..... E04G 11/06

(52) U.S. Cl. ..... 249/45; 249/40; 249/45; 249/192; 249/219.1; 249/219.2

(58) Field of Search ..... 249/219.1, 219.2, 249/192, 193, 47, 40, 44, 45, 25, 26

(56) References Cited

U.S. PATENT DOCUMENTS

| | | | | |
|---|---|---|---|---|
| 1,970,547 A | | 8/1934 | Anderson | 25/131 |
| 2,017,553 A | | 10/1935 | Troiel | 25/131 |
| 2,236,616 A | | 4/1941 | Bosco | 25/131 |
| 2,644,219 A | | 7/1953 | Williams | 25/131 |
| 2,940,153 A | | 6/1960 | Allen | 25/131 |
| 2,977,659 A | | 4/1961 | Buxton | 25/131 |
| 3,273,848 A | | 9/1966 | Allen et al. | 249/219 |
| 3,315,937 A | | 4/1967 | Eriksson | 249/44 |
| 3,430,913 A | | 3/1969 | Johnson | 249/217 |
| 3,547,398 A | | 12/1970 | Furr et al. | 249/219 |
| 3,712,576 A | | 1/1973 | Dagiel | 249/192 |
| 3,815,862 A | | 6/1974 | Williams | 249/40 |
| 3,858,866 A | * | 1/1975 | Armstrong et al. | 269/46 |
| 4,350,318 A | * | 9/1982 | Gallis | 249/40 |
| 5,857,300 A | * | 1/1999 | Gates | 52/426 |

* cited by examiner

*Primary Examiner*—Carl D. Friedman
*Assistant Examiner*—Pat J. Chavez
(74) *Attorney, Agent, or Firm*—Marshall, Gerstein, & Borun

(57) ABSTRACT

A waler bracket is disclosed for securing a waler to a modular form system having a pair of panels being separated by a filler channel, with the filler channel including a pair of flanges with each flange being joinable to an adjacent panel edge portion. The waler bracket includes an inner portion and an outer portion. The inner portion includes an inner through member disposed parallel to the plane of the panels and perpendicular to the panel edge portions, with the inner through member being sized for insertion between the filler channel flanges and being adapted to receive a fastener. The outer portion is adapted for attachment to the waler. Accordingly, the panels, the filler channel, and the bracket inner portion may be connected to each other using a fastener extending through the inner through member, and the waler may be secured to the bracket outer portion, thereby securing the waler to the panels and thereby permitting the form system to be lifted as a unit.

26 Claims, 7 Drawing Sheets

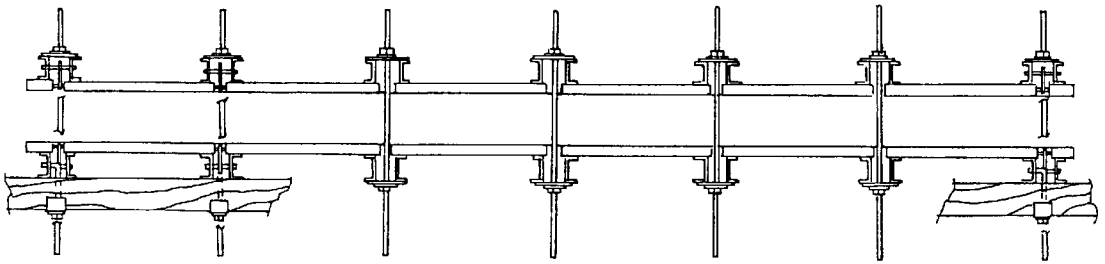
FIG.9B
FIG.9A
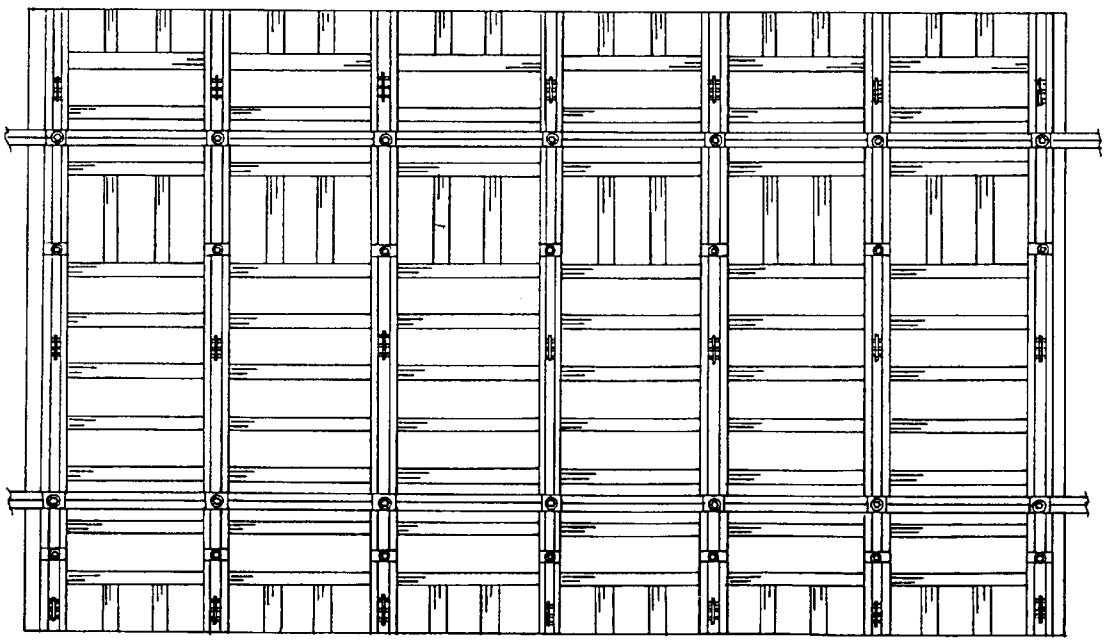
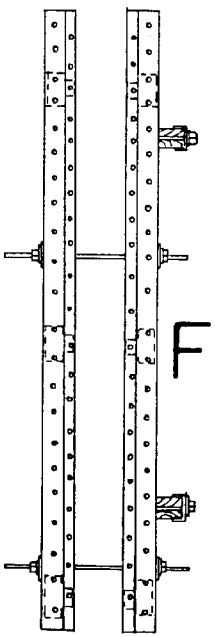
FIG.9C

CONCRETE FORM WALER BRACKET

FIELD OF THE INVENTION

The present invention relates to modular concrete forming systems. More specifically, the present invention relates to a bracket for securing a vertical waler or a horizontal strongback to a plurality of concrete forming panels.

BACKGROUND OF THE INVENTION

Modular forming systems are generally well known in the art. A very early example of a modular forming system may be found in U.S. Pat. No. 1,970,547. Modular forming systems are favored because they permit the rapid assembly of the wall forms for concrete walls of practically any dimension by using a discrete number of premanufactured modular form sections. After the concrete wall has been poured and cured, a modular forming system may be disassembled and used again at another location.

In the assembly of a modular wall form, a number of panel sections are joined to each other. A filler channel is typically inserted between adjacent panel sections, with the filler channel accommodating securing hardware for securing the adjacent panel sections to each other. The filler channel also accommodates the plurality of cross-ties that connect one wall panel unit to the opposing wall panel unit on the other side of the concrete wall to be formed. A number of vertical and horizontal stiffening members are provided in order to prevent the wall form unit from bowing outwardly or otherwise deforming when the uncured concrete is poured into the form. The vertical reinforcing members are typically termed "walers", while the horizontal reinforcing members are typically termed "strongbacks."

On any modular form system, a number of mounting brackets or other attachment systems must be provided for securing the walers or strongbacks to the form system. Ideally, such mounting brackets should be easy to assemble and disassemble, and should provide adequate securement of the waler or the strongback to the form system. The prior art discloses a variety of approaches for securing the stiffening members to the form system. For example, U.S. Pat. No. 1,970,547 issued to Anderson, U.S. Pat. No. 2,017,553 issued to Troiel, U.S. Pat. No. 2,977,659 issued to Buxton, and U.S. Pat. No. 2,940,153 issued to Allen all disclose examples of various brackets or systems for securing the stiffening members to the wall form.

Nevertheless, there exists a continuing need for an improved bracket for securing the vertical and/or horizontal stiffening members to a wall form system. Such a bracket should facilitate easy assembly and disassembly of the form system, and should also provide for adequate securement of the stiffening members to the wall system.

SUMMARY OF THE INVENTION

A modular concrete forming system assembled using a waler bracket constructed in accordance with the teachings of the present invention will provide a more secure, positive connection between the vertical and/or horizontal stiffening members and the wall panels.

According to one aspect of the invention, a waler bracket is provided for securing a waler to a modular form system having a pair of panels being separated by a filler channel, with the filler channel including a pair of flanges with each flange being joinable to an adjacent panel edge portion. The waler bracket includes an inner portion and an outer portion. The inner portion includes an inner through member disposed parallel to the plane of the panels and perpendicular to the panel edge portions, with the inner through member being sized for insertion between the filler channel flanges and being adapted to receive a fastener. The outer portion is adapted for attachment to the waler. Accordingly, the panels, the filler channel, and the bracket inner portion may be connected to each other using a fastener extending through the inner through member, and the waler may be secured to the bracket outer portion, thereby securing the waler to the panels and thereby permitting the form system to be lifted as a unit.

In further accordance with a preferred embodiment, the bracket outer portion is adapted to prevent relative rotation of the bracket or the waler about an axis parallel to the inner through member. The bracket outer portion may include a pair of outer through members, with each outer through member being adapted to receive a fastener such that the waler is secured to the bracket outer portion using fasteners inserted through the outer through members. The outer through members may be oriented parallel to the inner through member.

The waler may include a pair of spaced apart webs, and the bracket outer portion through member or through members may be sized for insertion between the waler webs. Preferably, the outer through members, inserted between the waler webs, are oriented parallel to the inner through member. The bracket includes a plate, and the inner through member includes a tube mounted to and extending through the plate. The outer through member or members also include a tube. Preferably, the tubes extend perpendicularly through the plate. Each of the tubes includes a pair of opposite planar ends, the inner tube ends being adapted to abut the filler channel flanges, the outer tube ends being adapted to abut the waler webs. The bracket plate includes a central portion extending between the inner and outer portions.

In accordance with another aspect of the invention, a waler bracket is provided for securing a waler to a modular form system. The modular form system includes a pair of panels and a filler channel for placement between the panels edge, with the filler channel including a pair of flanges with each flange being joinable to an adjacent panel side edge. The waler bracket includes an inner portion and an outer portion, inner securing means for securing the inner portion to the filler channel flanges and further for securing the filler channel flanges to the adjacent side edge portion of the panels. The inner securing means further includes an inner through member disposed horizontally and parallel to the plane of the panels, and the inner through member is adapted to receive therethrough a fastener. Outer securing means are provided for securing the waler to the bracket outer portion, with the outer securing means including an outer through member disposed parallel to the plane of the panels. The outer through member is adapted to receive a fastener. Accordingly, upon connecting the panels, the filler channel, and the waler using the bracket, the modular form system is liftable as an integral unit.

In accordance with yet another aspect of the invention, a modular concrete forming unit comprises a pair of panels, with each of the panels having a pair of side edges, top and bottom edges, and an interconnecting planar surface. A filler channel is adapted for placement between the panels and includes a pair of flanges and an interconnecting planar web, with each filler channel flange being adapted for connection to an adjacent panel side edge. A stiffening waler and a joining bracket are provided. The joining bracket includes an inner portion having an inner through member, an outer portion having an outer through member, and a central portion connecting the inner and outer portions. The inner through member is adapted for insertion between the filler channel flanges, while the outer through member is adapted for connection to the waler. Each of the through members are adapted to receive a fastener. Accordingly, the panels, the filler channel, and bracket inner portion are connected upon inserting a fastener through the panel side edges, the channel flanges, and the bracket inner through member. Consequently, the waler may be secured to the bracket outer portion upon inserting a fastener through the waler and the bracket outer through member, thereby creating the forming unit.

According to a still further aspect of the invention, a method of assembling a concrete forming unit comprises the steps of placing a filler channel having a pair of side flanges between the side edges of a pair of panels, inserting the inner portion of a bracket having an inner through member between the channel flanges, connecting the bracket inner portion, the filler channel, and the adjacent panel side edges by inserting a fastener horizontally through the inner through member, positioning a vertical waler having a pair of spaced apart webs adjacent to an outer portion of the bracket and parallel to the plane of the panels, with the bracket outer portion having an outer through member, and connecting the waler to the bracket outer portion by inserting a fastener through the outer through member.

BRIEF DESCRIPTION OF THE DRAWINGS

FIG. 9A is an elevational view of illustrating one manner of assembling a plurality of eight foot high and four foot high walls panels to create a twelve foot high wall ready to receive the horizontal stiffening member using the waler bracket of the present invention;

FIG. 9B is a top plan view thereof; and

FIG. 9C is a side elevational view taken along line 9C—9C of FIG. 9A.

DETAILED DESCRIPTION OF THE PREFERRED EMBODIMENT

The embodiment described herein is not intended to be exhaustive or to limit the scope of the invention to the precise form disclosed. The following embodiment has been chosen and described in order to best explain the principles of the invention and to enable others skilled in the art to follow its teachings.

Figure 4:
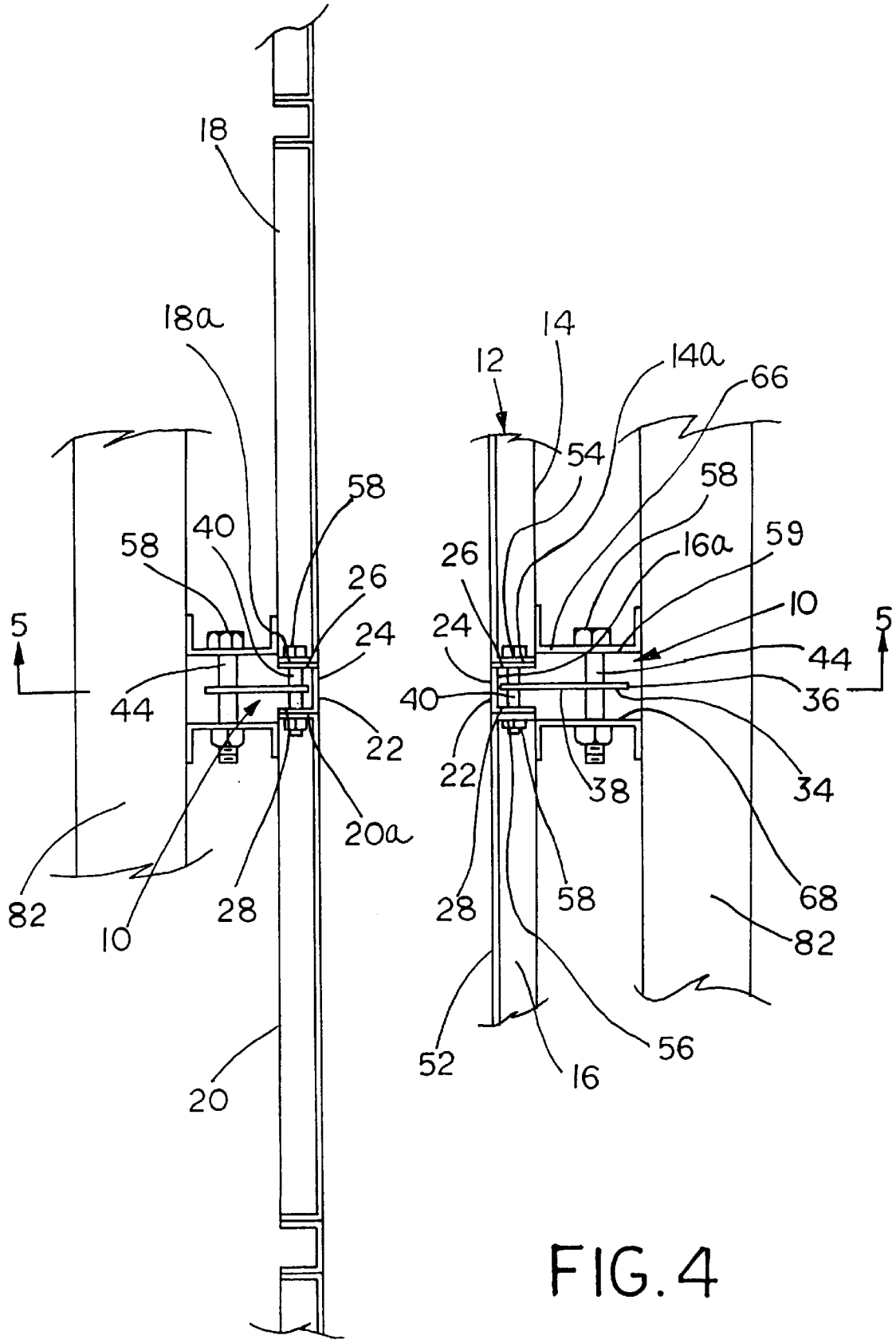
FIG. 4 is a fragmentary top plan view of the present connecting bracket shown securing a vertical waler to a modular wall form system and also illustrating a horizontal strongback secured to the unit.
Figure 8:
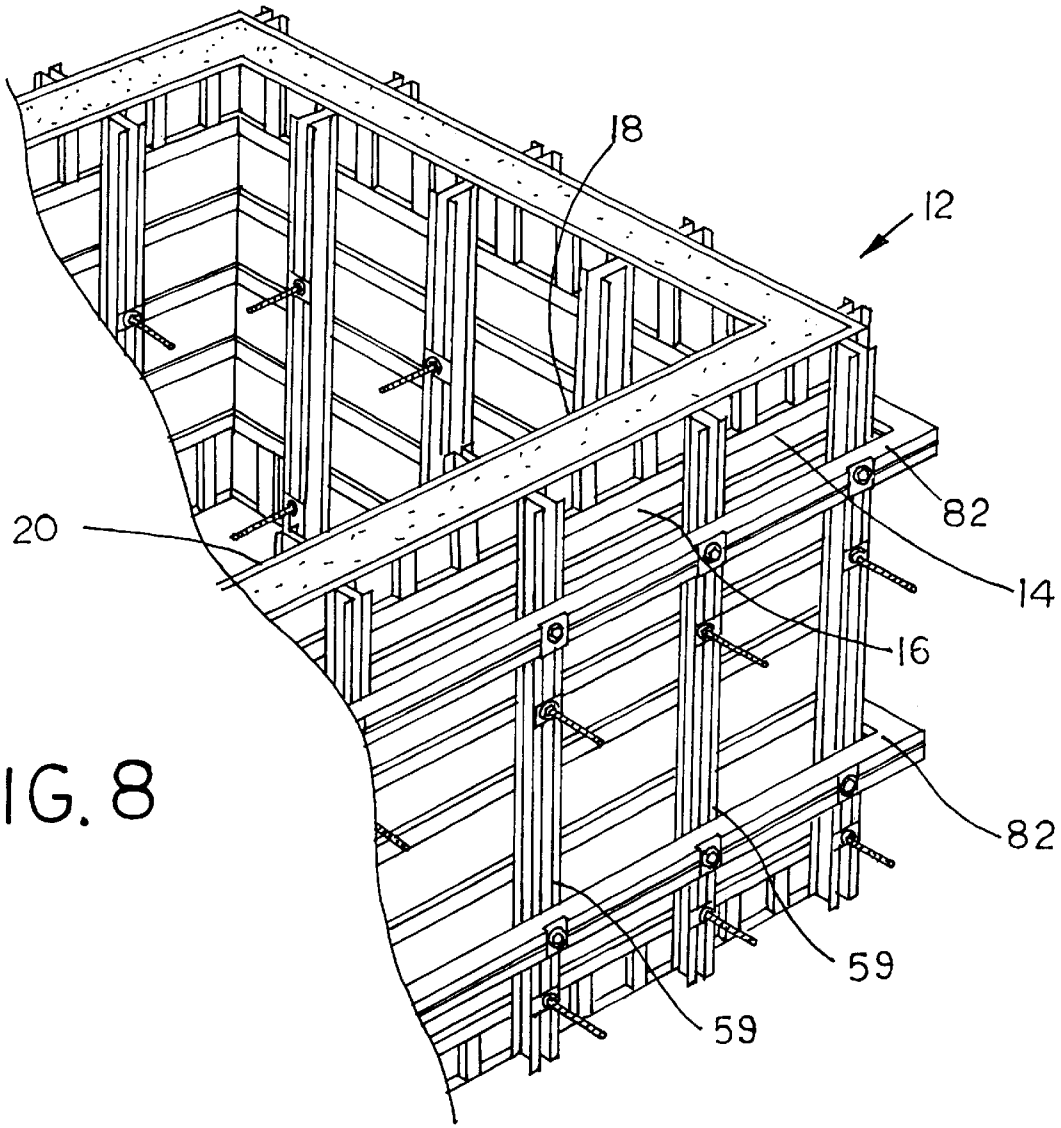
FIG. 8 is a perspective view of an assembled wall form unit connected using a bracket constructed in accordance with the teachings of the present invention.

Referring now to FIGS. 1–4 of the drawings, a waler bracket constructed in accordance with the teachings of the present invention is shown and is generally referred to by the reference numeral 10. As shown in FIG. 4, the waler bracket 10 is preferably used to assemble a modular wall system 12 having a plurality of wall panels 14, 16, 18 and 20. As shown in FIG. 8, it will be understood that a number of additional wall panels will typically be provided in order to assemble a complete modular wall system 12. These additional wall panels may also include panels stacked on top of the panels shown in order to assemble a taller form system necessary to construct a taller concrete wall. For the sake of convenience however, only the wall panels 14, 16, 18 and 20 will be described in any detail, it being understood that the remaining wall panels are substantially similar to those described.

Figure 5:
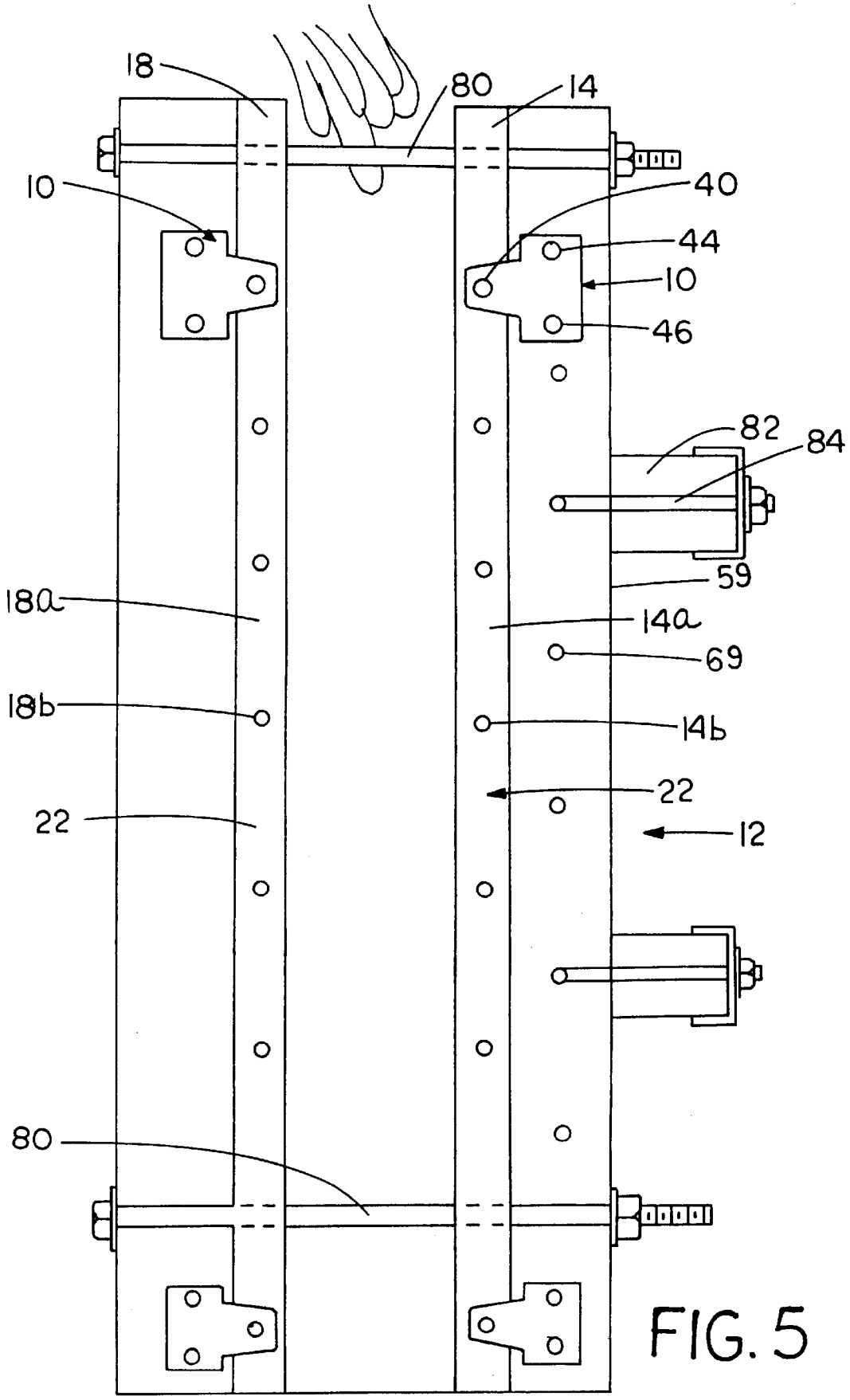
FIG. 5 is a cross-sectional view taken along line 5—5 of FIG. 4.
Figure 6:
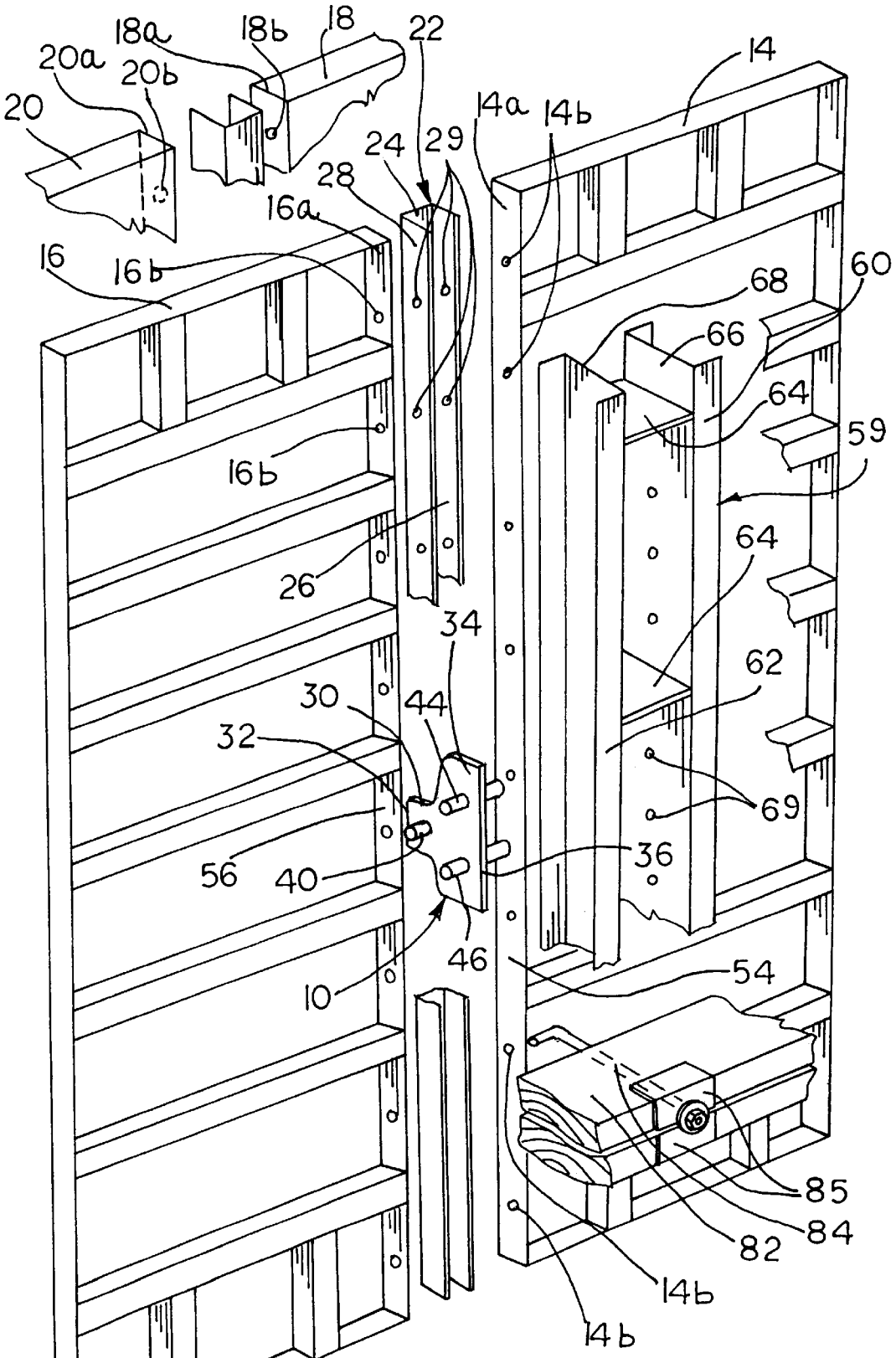
FIG. 6 is a fragmentary exploded view on perspective illustrating a pair of wall panels, a filler channel, vertical and horizontal stiffening members, and a connecting bracket.

As shown in FIGS. 4, 5 and 6, the wall panel 14 includes a vertical edge 14*a,* while the wall panel 16 includes a vertical edge 16*a.* Similarly, the wall panels 18 and 20 include vertical edges 18*a,* 20*a,* respectively. The edges 18*a,* 20*a* each include a series of holes 18*b,* 20*b* (FIG. 6), respectively, along the length thereof. The holes 14*b,* 16*b,* 18*b* and 20*b* are preferably spaced at appropriate intervals along their respective vertical edges, with either eight (8) inch or twelve (12) inch intervals being preferred. A filler channel 22 is disposed between wall panels 14 and 16, and another filler channel 22 is disposed between wall panels 18 and 20. Each filler channel 22 is secured to its adjacent wall panels in a manner discussed in greater detail below. Each filler channel 22 includes a web 24 and a pair of flanges 26, 28. The flanges 26, 28 include a series of aligned holes 29, which are preferably spaced twelve (12) inches apart along the length of the filler channels 22. For the sake of convenience, only the bracket 10 between the wall panels 14, 16 will discussed in detail herein, it being fully understood that the bracket 10 between the wall panels 18, 20 will typically be the same in all respects.

Referring to FIGS. 1 through 4, the waler bracket 10 includes an inner portion 30 terminating in an inner edge 32, and also includes an outer portion 34 terminating in an outer edge 36. The waler bracket 10 includes a central portion 38, which in the preferred embodiment is constructed of a generally planar steel or metallic plate, preferably ⅜ inch thick, and which interconnects the inner portion 30 and the outer portion 34.

An inner through member 40 extends through the inner portion 30, and includes a bore 42 extending therethrough. A pair of outer through members 44, 46 extend through the outer portion 34, each of which includes a bore 48, 50, respectively. Preferably, the through members 40, 46 and 48 are all parallel to each other. As will be noted from FIG. 4, the inner through member 40 may be oriented such that the bore 42 extends parallel to a planar surface 52 defined by the adjacent wall panels 14, 16. Each of the panel edges 14*a,* 16*a* includes a planar flange 54, 56, respectively, which extend generally perpendicular to the planar surface 52. It will be noted that the flange 54 abuts and is parallel to the flange 26 of the filler channel 22, while the flange 56 abuts and is parallel to the flange 28 of the filler channel 22. Further, it will be noted that the through member 40 and the bore 42 may be oriented perpendicular to the plane of the flanges 54, 56. Each of the through members is adapted to receive therethrough a mounting bolt 58, or any other suitable fastener. As can be seen in FIG. 4, the inner through member 40 is sized so as to fit between the inner edges of the flanges 24, 26 of the filler channel 32. The through members 40, 44, 46 are preferably formed of steel pipe sections having an outside diameter of 0.9375 inches and an inside diameter of 0.688 inches. Further, the center of the through members 44, 46 lie along a line spaced preferably 3½ inches away from the center of the through member 40. Other dimensions may be possible depending on the dimensions of the assembled components.

As shown in FIGS. 4 and 6, a vertical waler 59 or other stiffening member preferably includes a pair of spaced apart members 60, 62 which are secured to each other using a plurality of spacers or plates 64. The plates 64 may be spaced at any suitable intervals as would be known to those of skill in the art, and may be secured by fillet welds. Preferably, the members 60, 62 are C-sections, with each member 60, 62 including a web 66, 68, respectively. The webs 66, 68 include a series of aligned holes 69, which holes are preferably spaced six (6) inches apart along the length of the vertical waler 59, so that the outer through members 44, 46 of the waler bracket 10 may be secured to the vertical waler 59 in the manner described in greater detail below. As shown in FIG. 4, the outer through members 44, 46 are sized to be received between the spaced apart webs 66, 68 of the members 60, 62. The outer portion 34 of the bracket 10 may thus be secured to the waler 59 using a pair of the bolts 58 inserted through the aligned holes 69 in the webs 66, 68 of the waler 59.

Figure 1:
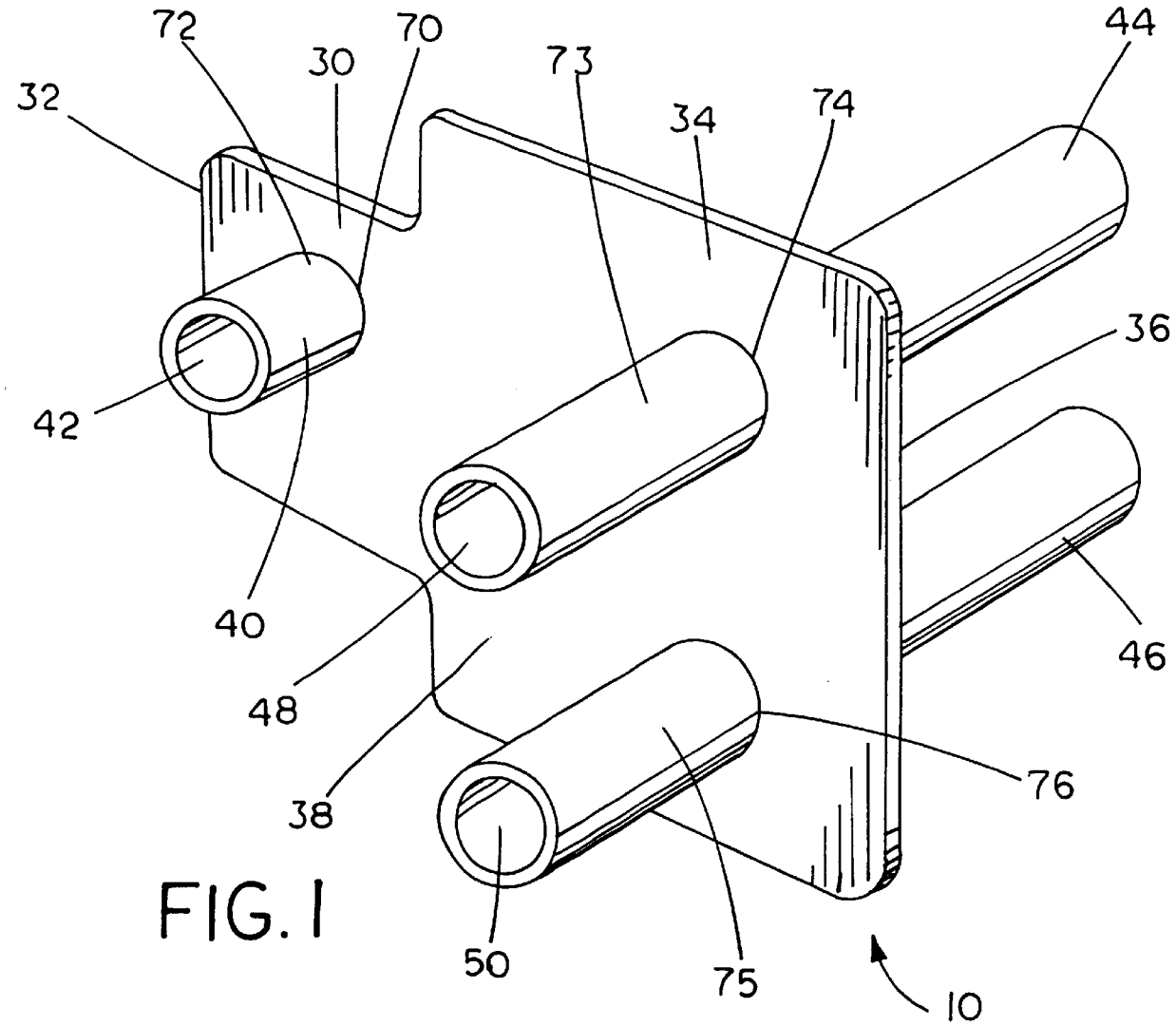
FIG. 1 is a fragmentary view in perspective of a connecting bracket constructed in accordance with the teachings of the present invention.
Figure 3:
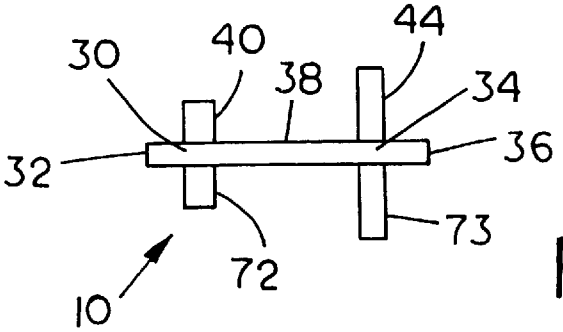
FIG. 3 is a top plan view thereof.
Figure 7:
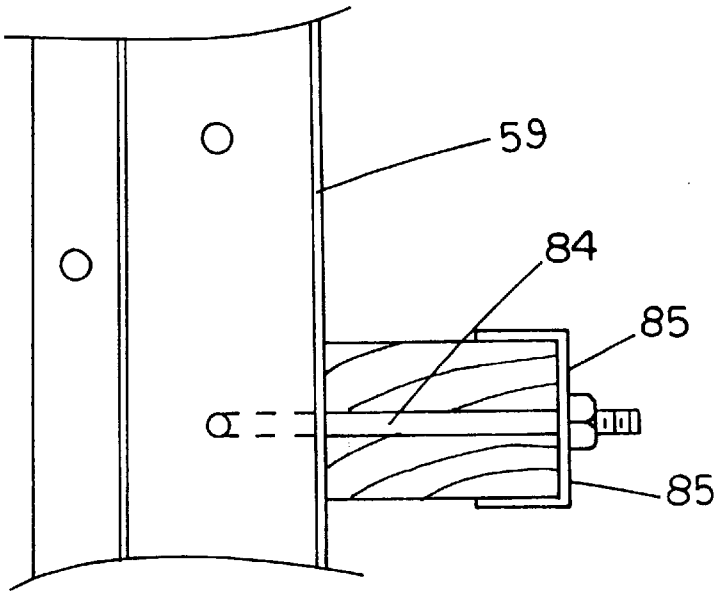
FIG. 7 is a fragmentary elevational view illustrating the manner by which a horizontal strongback may be secured to a vertical waler using a J-bolt.
Figure 2:
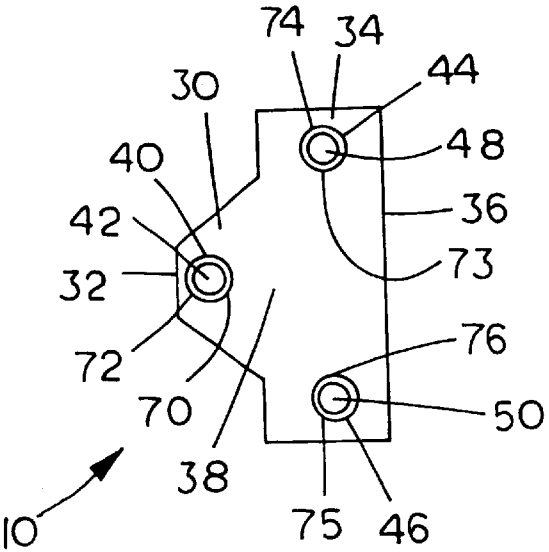
FIG. 2 is an elevational view thereof.

As shown in FIGS. 1 and 2, the inner portion 30 of the bracket 10 may include a hole or aperture 70, and the inner through member 40 may be formed of a steel tube 72 which is sized to extend through the aperture 70. The steel tube 72 may be secured to the bracket 10 such as by a fillet weld. Similarly, the outer through members 44, 46 each may include a tube 73, 75, which may extend through apertures or holes 74, 76, respectively. The tubes 73, 75 may similarly be secured by fillet welds. It will be noted from FIG. 2 that the holes 69 on the waler 59 are spaced so as to be offset from the holes 29 on the filler channel 22.

In operation, the modular wall form system 12 is assembled using the waler bracket 10 in the following manner. The filler channel 22 is disposed between the wall panels 14, 16. The panels 14, 16 may be secured to the channel by inserting any suitable fasteners through the holes 18*b*, 20*b* and 29, through the panel 14, the panel 16, and the filler channel 22, respectively, thus forming a panel unit 78 consisting of the panels 14, 16 and the filler channel 22. The panel unit 78 forms a portion of the planar surface 52. The suitable fasteners may be bolts or pin/wedge fasteners of the type commonly employed in the art.

The waler 59 is then secured to the panel unit 78 as follows. The inner through member 40 is positioned such that the tube 72 is disposed between the flanges 26, 28 of the filler channel 22. A bolt 58 is inserted through the hole 18*b* in the panel 14, the hole 29 in the flange 26 of the filler channel 22, through the through member 40, through the hole 29 in the flange 28, and through the hole 20*b* in the panel 16. The vertical location of the waler bracket 10 relative to the panels 14, 16, as well as the number of waler brackets 10, may be chosen by the installer or the form designer based on known considerations.

The waler bracket 10 is secured to the waler 59 by inserting the outer through members 44, 46 between the webs 66, 68 of the waler 59. The outer through members are secured to the waler 59 by inserting bolts through the appropriate holes 69 and the bores 48, 50, respectively. One or more horizontal strongbacks 82, such as paired 2×6's, are then secured to the assembled structure by use of a J-bolt 84, such as a ½ inch J-bolt, inserted through an available one of the holes 69 in either of the webs 66, 68 of the waler 59. Preferably, paired L-shaped washers 85 are provided for bearing against the 2×6's.

It will be noted that the precise or order of this assembly may be varied. For example, the outer portion 34 of the waler bracket 10 may first be secured to the waler 59, and the inner portion 30 may be then secured to the assembled panel unit 78 of the panels 14, 16 and the filler channel 22. Alternatively, the inner portion 30 of the waler bracket 10 may first be secured to the panel unit 78 unit as described above, and thereafter the outer portion 34 may be secured to the waler 59 in the above described manner.

An opposite wall panel unit 78, consisting of wall panels 18 and 20, is assembled in the same or similar manner. It will be noted that when the form system 10 is fully assembled as shown in FIG. 8, a plurality of crossties 80 (viewable in FIG. 5) will be secured between the panels 14, 16 and the panels 18, 20, as would be known to those of skill in the art. Preferably, the cross ties 80 are tapered removable ties of the type commonly employed in the art.

Moreover, it will be noted that the present waler bracket 10 will permit the lift of the waler 14 and the attached wall panels 14, 16 is an integral unit. Moreover, the three-point attachment provided by the attachment bolts 58 through each of the through members 40, 44 and 46 prevents the waler bracket 10 (and hence the waler 59) from rotating relative to the planar surface 52. Hence, the unit 78 may be lifted as a single structure.

FIGS. 9A, 9B and 9C illustrate the manner by which a number of wall panels of differing heights, such as eight foot and four foot panels, may be assembled to form a twelve foot wall. It is contemplated that other wall systems may be assembled in a similar manner using the waler bracket of the present invention.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A bracket for securing a waler to a modular form system, the modular form system including a waler and a pair of panels being separated by a filler channel, the filler channel including a pair of flanges with each flange being joinable to an adjacent panel edge portion, the bracket comprising:

an inner portion, the inner portion including an inner through member, the inner through member being sized for insertion between the filler channel flanges when the inner through member is positioned perpendicular to the filler channel flanges, the inner through member further being adapted to receive a fastener; and an outer portion; the outer portion being adapted for attachment to the waler;

whereby the bracket inner portion is joinable to the filler channel flanges and the panel edge portions using a fastener extending through the inner through member, and whereby the bracket outer portion is joinable to the waler, thereby permitting the modular form system to be lifted as a unit.

2. The bracket of claim 1, wherein the bracket outer portion is adapted to prevent relative rotation of the bracket or the waler about an axis parallel to the inner through member.

3. The bracket of claim 1, wherein the bracket outer portion includes a pair of outer through members, each outer through member being adapted to receive a fastener, and further wherein the waler is secured to the bracket outer portion using fasteners inserted through the outer through members.

4. The bracket of claim 3, wherein the outer through members are oriented parallel to the inner through member.

5. The bracket of claim 1, wherein the bracket outer portion includes a pair of outer through members.

6. The bracket of claim 1, wherein the pair of bracket outer portion through members are oriented parallel to the inner through member.

7. The bracket of claim 1, the waler including a pair of spaced apart webs, and wherein the bracket outer portion includes a through member sized for insertion between the waler webs.

8. The bracket of claim 7, wherein the outer through member is oriented parallel to the inner through member.

9. The bracket of claim 1, wherein the bracket includes a plate, and wherein the inner through member includes a tube mounted to and extending through the plate.

10. The bracket of claim 3, wherein each of the inner and outer through member includes a tube.

11. The bracket of claim 10, wherein the bracket includes a plate, each of the tubes extending perpendicularly through the plate.

12. The bracket of claim 1, wherein the bracket includes a central portion extending between the inner and outer portions, and further wherein the central portion includes an aperture.

13. The bracket of claim 11, wherein the waler includes a pair of parallel spaced apart webs, and further wherein each of the tubes includes a pair of opposite planar ends, the inner tube having a length sized so that the planar ends of the inner tube are positioned to abut the filler channel flanges, the outer tube having a length sized so that the planar ends of the outer tube are positioned to abut the waler webs.

14. For use with a modular form system having a waler, a pair of panels, and a filler channel for placement between side edges of the panels, the filler channel including a pair of flanges with each flange being joinable to a side edge of an adjacent panel, a bracket for securing the waler to the panels and the filler channel, the bracket comprising:

an inner portion and an outer portion;

inner securing means for permitting securement of the inner portion to the filler channel flanges and further for permitting securement of the filler channel flanges to the adjacent side edge portion of the panels, the inner securing means including an inner through member sized to be disposed horizontally and parallel to the plane of the panels, the inner through member being adapted to receive therethrough a fastener; and outer securing means for permitting securement of the waler to the bracket outer portion, the outer securing means including an outer through member sized to be disposed parallel to the plane of the panels, the outer through member being adapted to receive a fastener;

whereby upon connecting the panels, the filler channel, and the waler using the bracket the modular form system is liftable as an integral unit.

15. The bracket of claim 14, wherein the outer through member is disposed parallel to the inner through member.

16. The bracket of claim 14, wherein the outer securing means includes a pair of through members, the pair of outer through members being disposed parallel to the inner through member.

17. The bracket of claim 14, the waler including a pair of spaced apart webs, and wherein the outer through member is sized for insertion between the waler webs.

18. The bracket of claim 14, wherein the bracket includes a plate, and wherein the inner and outer through members each includes a tube mounted to and extending through the plate.

19. The bracket of claim 14, wherein the bracket includes a central portion extending between the inner and outer portions, and further wherein the central portion includes an aperture.

20. The bracket of claim 18, wherein the waler includes a pair of parallel spaced apart webs, and further wherein each of the tubes includes a pair of opposite planar ends, the tube of the inner through member being sized so that the ends of the tube are positioned to abut the filler channel flanges, the tube of the outer through member being sized so that the ends of the tube are positioned to abut the waler webs.

21. A modular concrete forming unit, comprising:

a pair of panels, each of the panels having a pair of side edges, top and bottom edges, and an interconnecting planar surface, a filler channel adapted for placement between the panels and having a pair of flanges and an interconnecting planar web, each filler channel flange being adapted for connection to an adjacent panel side edge;

a waler; and a joining bracket, the joining bracket including an inner portion having an inner through member, an outer portion having an outer through member, and a central portion connecting the inner and outer portions, the inner through member being adapted for insertion between the filler channel flanges and the outer through member being adapted for connection to the waler, each of the through members being adapted to receive a fastener;

whereby the panels, filler channel, and bracket inner portion are connected upon inserting a fastener through the panel side edges, the channel flanges, and the bracket inner through member, and whereby the waler is secured to the bracket outer portion upon inserting a fastener through the waler and the bracket outer through member, thereby creating the forming unit.

22. The forming unit of claim 21, wherein the waler is vertically oriented and includes a pair of parallel spaced apart webs, the outer through member being adapted for insertion between the waler webs.

23. A method of assembling a concrete forming unit, comprising the steps of:

placing a filler channel having a pair of side flanges between the side edges of a pair of panels;

inserting the inner portion of a bracket having an inner through member between the channel flanges;

connecting the bracket inner portion, the filler channel, and the adjacent panel side edges by inserting a fastener horizontally through the inner through member;

positioning a vertical waler having a pair of spaced apart webs adjacent to an outer portion of the bracket and parallel to the plane of the panels, the bracket outer portion having an outer through member; and connecting the waler to the bracket outer portion by inserting a fastener through the outer through member.

24. The method of claim 23, including the additional step of securing a horizontal strongback to the vertical waler using a J-bolt.

25. A bracket for use with a modular form system, the modular form system including a pair of panels, a filler channel disposed between the panels to permit joining of the panels to each other, and a waler, the filler channel including a pair of opposed flanges with each of the flanges being joinable to an edge portion of the adjacent panels, the bracket comprising:

an inner portion, the inner portion sized to be positioned between the flanges of the filler channel, the inner portion further adapted to receive at least one fastener oriented perpendicular to the flanges when the inner portion is disposed between the flanges; and an outer portion, the outer portion adapted for attachment to the waler.

26. A modular concrete forming unit, comprising:

a pair of panels, each of the panels having a pair of side edges, top and bottom edges, and an interconnecting planar surface, a filler channel adapted for placement between the panels and having a pair of flanges and an interconnecting planar web, each filler channel flange being adapted for connection to an adjacent panel side edge;

a waler; and a joining bracket, the joining bracket including:

an inner portion, the inner portion sized to fit between the flanges of the filler channel and being joinable to the flanges of the filler channel;

an outer portion, the outer portion joinable to the waler; and a central portion connecting the inner and outer portions;

whereby the panels, the filler channel, and the inner portion of the bracket are connected using at least one first fastener, and whereby the outer portion of the bracket is connected to the waler using at least one second fastener, thereby creating the forming unit.

* * * * *